United States Patent [19]

Groeneveld et al.

[11] Patent Number: 4,826,746

[45] Date of Patent: May 2, 1989

[54] ELECTROPHOTOGRAPHIC PROCESS FOR FORMING A VISIBLE IMAGE

[75] Inventors: Marinus Groeneveld, Geldrop; Gerardus G. Draisma, Venlo, both of Netherlands

[73] Assignee: Oce-Nederland B.V., Venlo, Netherlands

[21] Appl. No.: 56,545

[22] Filed: Jun. 1, 1987

Related U.S. Application Data

[63] Continuation-in-part of Ser. No. 816,192, Jan. 6, 1986, abandoned.

[51] Int. Cl.[4] ..... G03G 13/22; G03G 13/08

[52] U.S. Cl. ..... 430/31; 430/84; 430/903; 430/120

[58] Field of Search ..... 430/84, 903, 31, 120

[56] References Cited

U.S. PATENT DOCUMENTS

| | | | |
|---|---|---|---|
| 4,297,392 | 10/1981 | Higashi et al. | 430/84 X |
| 4,356,246 | 10/1982 | Tabei et al. | 430/84 X |
| 4,403,026 | 9/1983 | Shimizu et al. | 430/84 X |
| 4,487,825 | 12/1984 | Gruber et al. | 430/903 X |
| 4,557,990 | 12/1985 | Nakagawa et al. | 430/84 |
| 4,560,634 | 12/1985 | Matsuo et al. | 430/84 |

*Primary Examiner*—Roland E. Martin

*Attorney, Agent, or Firm*—Reed Smith Shaw & McClay

[57] ABSTRACT

A process for forming a visible image in which an electrophotographic element having a homogeneous and amorphous silicon layer as the sole photoconductive layer is provided with a charge image and the charge image is developed by a developing powder. The electrophotographic element has a very thin silicon layer with a thickness between 0.5 and 3 μm and a dark decay time greater than 25 seconds. The photoconductive layer is developed by a one-component developing powder having a resistivity of less than $10^5$ ohm.meter.

1 Claim, No Drawings

ELECTROPHOTOGRAPHIC PROCESS FOR FORMING A VISIBLE IMAGE

RELATION TO OTHER APPLICATIONS

This application is a continuation-in-part of pending application Ser. No. 816,192 entitled "Electrophotographic Process For Forming A Visible Image," filed on Jan. 6, 1986.

FIELD OF THE INVENTION

The present invention relates to a process for forming a visible image using an electrophotographic element having a silicon layer as the sole photoconductive layer for a charge image to be developed by a developing powder.

BACKGROUND OF THE INVENTION

Electrophotographic methods using electrostatic developing are well known. Such methods utilize conductive developers, e.g., British Pat. No. 1,567,219 and U.S. Pat. No. 4,060,451. The latter patent discloses a thin zinc oxide photoconductive layer using a one component toner having a resistivity below $10^5$ ohm.m. See also British Pat. No. 1,406,983 relating to a one component toner powder.

In addition to zinc oxide, selenium, in the form of amorphous selenium, is used as a photoconductive layer on rotating drums. In other photosensitive devices, other types of electrically conductive substrates such as amorphous silicon and silicon-germanium have been used. See U.S. Pat. No. 4,451,546. However, such materials have not found application in electrophotography.

In U.S. Pat. No. 4,225,222 there is disclosed a process for producing an amorphous silicon layer on a drum which is from 10 to 100 μm thick. The advantage of this silicon layer is that it has considerable resistance to wear. However, it has the significant disadvantage that the dark-decay rate is too high for practical applications. Consequently, it is an object of the present invention to obviate the disadvantage caused by a high dark decay rate or a fast dark decay time.

To reduce the dark decay rate and increase the dark decay time it has been proposed to provide a thick silicon layer with a thin top layer of silicon nitride or silicon carbide. Although a top layer of this kind has some beneficial effect, it is not sufficient to eliminate the problem of a high dark decay rate or an excessively fast dark decay time. The major benefit of such a layer is to increase the surface hardness of the silicon layer thereby improving its wear resistance, such as described in Japanese Patent Application No. 57-200047.

U.S. Pat. No. 4,297,392 discloses a method of producing a electrophotographic element having a thin film of amorphous silicon under specific conditions. While a broad range of thicknesses for the film layer is mentioned, there is no statement as to the actual dark decay rate of the film layer and no indication that very thin layers, such as between 0.5 and 3 μm, have a high dark decay time, namely greater than 25 seconds, compared to thicker layers. Moreover, the proposed increase in the time constant or surface potential decay, mentioned in the patent, is only achieved by the use of a separate insulating layer. See FIG. 3 and Column 5, lines 20–26.

DESCRIPTION OF THE INVENTION

Generally, the present invention provides an electrophotographic element having a silicon layer of a thickness between 0.5 and 3 μm and a process in which said element is developed by a one-component developing powder having a resistivity of less than $10^5$ ohm.meter. As used herein, the term "silicon layer" denotes a layer consisting mainly of homogeneous and amorphous silicon. Such layers can be formed by depositing silicon on a support from silane under the influence of a radio frequency field. It is also possible to incorporate smaller quantities of other elements by mixing the silane with one or more other hydrides, such as a diborane.

It has been found that the dark decay rate of silicon layers (i.e. the rate at which a layer is discharged) can be significantly reduced by using a thin layer of a thickness of less than 3 μm. By reducing the dark decay rate, the charge stays on the layer longer (i.e. the dark decay time increases). This reduction can be accomplished without the presence of an insulating layer. Although the preferred embodiment uses a very thin (0.2 μm) layer of silicon nitride or silicon carbide on top of the silicon layer, this layer is for improved wear characteristics. As has been mentioned before, the effect this insulating layer has on the dark decay rate of the silicon layer is negligible.

It has been further found that, expressed as percentages of the maximum charge, the dark decay rate of a silicon layer of a thickness of 2.5 μm is approximately one-fifth that of the layer having the same composition but of a thickness of 20 μm. In other words, by decreasing the thickness of the layer of silicon so that it is in the range of 0.5 to about 5 μm, the dark decay time is increased so that it is greater than 25 seconds.

It has also been found that the maximum charge level of silicon layers of a thickness less than 3 μm, expressed in volt per μm thickness, is much higher than that of thicker layers. For example, silicon layers with a thickness less than 3 μm typically have a maximum potential per unit thickness of greater than 30v/μm while those layers between 5 and 20 μm only have a maximum potential per unit thickness of between about 20 and 26v/μm. This increase in maximum potential per unit thickness increases the dark decay time and decreases the dark decay rate.

The result of the very small or low thickness of the silicon layer of the electrophotographic element in the process according to the present invention is that, despite the increased maximum charge level in volt per μm thickness, the absolute charge level of the layer is relatively low. In order to develop charge images of a relatively low charge level at reasonable speed, it is preferred to use a conductive developing powder having a resistivity less than $10^5$ ohm.m with the preferred toner. The process according to the invention has the advantage that a flexible electrophotographic belt may be used because the thin silicon layer tolerates the bending and stretching of a belt in an electrophotographic process without any problems.

Other advantages of the present invention will become apparent from reference to the following examples of the present preferred embodiment of the best mode of carrying out the invention.

ILLUSTRATIVE EXAMPLES OF THE PRESENT MODE

EXAMPLE 1

An aluminum support is successively coated with an aluminium oxide layer, a 2.5 μm thick silicon layer obtained by vapor-coating silicon hydride and boron hydride in a volume ratio of $1:10^{-4}$, and a silicon nitride top layer of a thickness of 0.2 μm. The photosensitive layer was initially charged to its maximum potential of 100 volts and after 5 seconds, the potential had only dropped 10% to 90 volt. Only after a dark decay time of 80 seconds had the charge on the photosensitive layer decayed to one-half its initial potential. Excellent copies with black image portions and a white background were obtained by image-wise exposure and development with a conductive developing powder having a resistivity of $10^3$ ohm.meter. An electrophotographic element of the same composition, but with a silicon layer 20 μm thick, lost 57% of its charge within 5 seconds after maximum charging.

EXAMPLE 2

An electrophotographic element having the same composition as in Example 1 but with a silicon layer having a thickness of 1.1 μm was initially charged to its maximum potential of 60 volts and was found to still have 93% of its charge after 5 seconds. Only after a dark decay time of 150 seconds had the charge on the photosensitive layer decayed to one-half of its initial potential. This element also gave excellent copies with black image portions and a white background after imagewise exposure and development with a conductive developing powder of a resistivity of $10^3$ ohm.meter.

EXAMPLE 3

An aluminum support is successively coated with an aluminium oxide layer, a 5.0 μm thick silicon layer obtained by a vapor-coating silicon hydride and boron hydride in a volume ratio of $1:10^{-4}$, and a silicon nitride top layer of a thickness of 0.2 μm. The photosensitive layer was initially charged to its maximum potential of 130 volts. It took only 25 seconds of dark decay time for the charge on the photosensitive layer to decay to one-half of its initial potential.

EXAMPLE 4

An aluminum support is successively coated with an aluminium oxide layer, a 10.0 μm thick silicon layer obtained by vapor-coating silicon hydride and boron hydride in a volume ratio of $1:10^{-4}$, and a silicon nitride top layer of a thickness of 0.2 μm. The photosensitive layer was initially charged to its maximum potential of 220 volts. It took only 12 seconds of dark decay time for the charge on the photosensitive layer to decay to one-half of its initial potential.

EXAMPLE 5

An aluminum support is successively coated with an aluminium oxide layer, a 15.0 μm thick silicon layer obtained by vapor-coating silicon hydride and boron hydride in a volume ratio of $1:10^{-4}$, and a silicon nitride top layer of a thickness of 0.2 μm. The photosensitive layer was initially charged to its maximum potential of 400 volts. It took only 6 seconds of dark decay time for the charge on the photosensitive layer to decay to one-half of its initial potential.

EXAMPLE 6

An aluminum support is successively coated with an aluminium oxide layer, a 20.0 μm thick silicon layer obtained by vapor-coating silicon hydride and boron hydride in a volume ratio of $1:10^{-4}$, and a silicon nitride top layer of a thickness of 0.2 μm. The photosensitive layer was initially charged to its maximum potential of 410 volts. It took only 4 seconds of dark decay time for the charge on the photosensitive layer to decay to one-half of its initial period.

Examples 1 and 2 are particularly useful when the time interval between charging and exposure and between exposure and development are not the same. For example, sharp clear images can be produced even if the electrophotographic element is charged stripwise, exposed integrally and developed stripwise. In examples 3–6, this is not the case. With these electrophotographic elements, if the time interval between charging and exposing the leading edge of the image area is longer than the time interval between charging and exposing the trailing edge, the image and/or the background will show density differences between the leading and trailing edges. Another disadvantage with examples 3–6 is that the total time between charging and development must be low enough due to the high decay rate.

In the foregoing examples, the resistivity of the developing powder was determined as follows: A rectangular tray with a brass base and side walls made of an insulating plastic was filled to the edge with developing powder. Internally, the base area of the tray was 9.6 $cm^2$ and the height of the tray was 2 cm. The opening of the tray filled with developing powder was closed by a 130 g conductive lid which fitted exactly in the opening. The base of the tray and the lid were connected to a 10 volt supply and the current in the resulting circuit was measured. The resistivity of the developing powder was calculated by dividing the product of the base area and the voltage by the product of the tray height and the current.

While a presently preferred embodiment of the invention has been disclosed and described with particularity, the invention may be otherwise embodied within the scope of the appended claims.

What is claimed is:

1. A process for forming a visible image in which an electrophotographic element is provided with an original value of uniform charge, the element is exposed image-wise to form a charge image and the charge image is developed by a one-component, conductive developing powder which is applied directly to the electrophotographic element for developing the charge image, the improvement comprising in combination therewith an electrophotographic element without a functional insulating layer but having a homogeneous and amorphous silicon layer of a thickness between 0.5 and 3 μm as the sole photoconductive layer such that the time it takes the charge image on the electrophotographic element to decay to one-half its original value is greater than 25 seconds and the one-component, conductive developing powder has a resistivity of less than $10^5$ ohm. meter.

* * * * *